US011087918B2

(12) United States Patent
Miyamoto et al.

(10) Patent No.: US 11,087,918 B2
(45) Date of Patent: Aug. 10, 2021

(54) COIL COMPONENT

(71) Applicant: Murata Manufacturing Co., Ltd., Kyoto-fu (JP)

(72) Inventors: Masashi Miyamoto, Nagaokakyo (JP); Shigeto Yamamoto, Nagaokakyo (JP); Kentaro Yamaguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 916 days.

(21) Appl. No.: 15/834,693

(22) Filed: Dec. 7, 2017

(65) Prior Publication Data

US 2018/0096782 A1 Apr. 5, 2018

Related U.S. Application Data

(63) Continuation of application No. PCT/JP2016/068234, filed on Jun. 20, 2016.

(30) Foreign Application Priority Data

Oct. 5, 2015 (JP) ..... JP2015-197510

(51) Int. Cl.
*H01F 27/28* (2006.01)
*H01F 27/34* (2006.01)
(Continued)

(52) U.S. Cl.
CPC ..... *H01F 27/34* (2013.01); *H01F 17/045* (2013.01); *H01F 27/006* (2013.01); *H01F 27/24* (2013.01); *H01F 27/2823* (2013.01)

(58) Field of Classification Search
CPC ..... H01F 27/34; H01F 17/045; H01F 27/006; H01F 27/24; H01F 27/2823
See application file for complete search history.

(56) References Cited

U.S. PATENT DOCUMENTS 6,339,364 B1 * 1/2002 Reddy ..... H03H 7/06 333/181
6,703,910 B1 * 3/2004 Lapushin ..... H01F 17/045 333/181
(Continued)

FOREIGN PATENT DOCUMENTS

CN 103887040 A 6/2014
JP 4789076 B2 10/2011
(Continued)

OTHER PUBLICATIONS

An Office Action by the China National Intellectual Property Administration dated Jul. 1, 2020, which corresponds to Chinese Patent Application No. 201811516332.X and is related to U.S. Appl. No. 15/834,693 with English language translation.
(Continued)

*Primary Examiner* — Mang Tin Bik Lian
(74) *Attorney, Agent, or Firm* — Studebaker & Brackett PC

(57) ABSTRACT

A 0.5-displacement region in which a first wire and a second wire are displaced by 0.5 turns from each other, and a 1.5-displacement region in which the first wire and the second wire are displaced by 1.5 turns in an opposite direction to a 0.5-displacement region are distributed along an axis direction on a winding core portion. The sum of the number of turns of the second wire located in the 0.5-displacement region being twice or more and five times or less than the sum of the number of turns of the second wire located in the 1.5-displacement region.

1 Claim, 10 Drawing Sheets

(51) Int. Cl.

| | |
|---|---|
| ***H01F 17/04*** | (2006.01) |
| ***H01F 27/00*** | (2006.01) |
| ***H01F 27/24*** | (2006.01) |

(56) References Cited

U.S. PATENT DOCUMENTS

| | | | | |
|---|---|---|---|---|
| 10,600,555 | B2 * | 3/2020 | Tomonari | H01F 27/2823 |
| 2014/0097928 | A1 * | 4/2014 | Tomonari | H01F 27/2823<br>336/207 |
| 2014/0167903 | A1 | 6/2014 | Tomonari et al. | |
| 2016/0155561 | A1 * | 6/2016 | Takagi | H01F 27/2823<br>336/222 |
| 2017/0221626 | A1 * | 8/2017 | Tomonari | H01F 27/2823 |

FOREIGN PATENT DOCUMENTS

| | | | |
|---|---|---|---|
| JP | 2011-253888 | A | 12/2011 |
| JP | 2014-075533 | A | 4/2014 |
| JP | 2014-120730 | A | 6/2014 |
| JP | 2014-199904 | A | 10/2014 |

OTHER PUBLICATIONS

International Search Report issued in PCT/JP2016/068234; dated Aug. 30, 2016.
Written Opinion issued in PCT/JP2016/068234; dated Aug. 30, 2016.

* cited by examiner

COIL COMPONENT

CROSS REFERENCE TO RELATED APPLICATIONS

This application claims benefit of priority to Japanese Patent Application 2015-197510 filed Oct. 5, 2015, and to International Patent Application No. PCT/JP2016/068234 filed Jun. 20, 2016, the entire content of which is incorporated herein by reference.

TECHNICAL FIELD

This disclosure relates to a coil component, and particularly relates to an improvement in winding of wire in a wire-wound coil component having a structure in which two wires are wound around a winding core portion.

BACKGROUND

A common mode choke coil is a representative example of a coil component to which this disclosure is directed.

A common mode choke coil that interests this disclosure is described in Japanese Patent No. 4789076, for example. FIG. 9 illustrates an outer appearance of a common mode choke coil 41 having basically the same configuration as that described in Japanese Patent No. 4789076.

As illustrated in FIG. 9, the common mode choke coil 41 includes a core 42, and a first wire 43 and a second wire 44 each of which configures an inductor. The core 42 is composed of an electrically insulative material, more specifically, of alumina as a dielectric, a Ni—Zn based ferrite as a magnetic body, resin, or the like. The core 42 is formed in the shape having a quadrangular cross-section as a whole. The wires 43 and are composed of copper wires with insulation coating, for example.

The core 42 includes a winding core portion 45, and a first flange portion 46 and a second flange portion 47 provided at respective end portions of the winding core portion 45. The first and second wires 43 and 44 are helically wound around the winding core portion 45 with substantially the same number of turns as each other from a first end portion on the first flange portion 46 side toward a second end portion on the second flange portion 47 side (opposite to the first end portion).

The first flange portion 46 is provided with first and second terminal electrodes 48 and 49, the second flange portion 47 is provided with third and fourth terminal electrodes 50 and 51. The terminal electrodes 48 to 51 are, for example, formed by baking of conductive paste, plating of conductive metal, or the like. Note that, as is clear from locations of the terminal electrodes 48 to 51, FIG. 9 illustrates the common mode choke coil 41 in a state where a mounting surface facing toward a mounting substrate is faced upward.

End portions of the first wire 43 are respectively connected to the first and third terminal electrodes 48 and 50, end portions of the second wire 44 are respectively connected to the second and fourth terminal electrodes 49 and 51. Thermal pressure bonding is applied to these connections, for example.

The common mode choke coil 41 configured as described above provides an equivalent circuit as illustrated in FIG. 10. In FIG. 10, elements corresponding to the elements illustrated in FIG. 9 are given the same reference numerals.

Referring to FIG. 10, the common mode choke coil 41 includes a first inductor 52 composed of the first wire 43 connected between the first and third terminal electrodes 48 and 50, and a second inductor 53 composed of the second wire 44 connected between the second and fourth terminal electrodes 49 and 51. The first inductor 52 and the second inductor 53 are magnetically coupled with each other.

Although not clearly illustrated in FIG. 9, the first wire 43 is wound in a state of constituting a first layer being in contact with the circumferential surface of the winding core portion 45, and the second wire 44 is wound in a state of mostly constituting a second layer on the outside of the first layer and a part of the second wire 44 in the second layer is fitted into a recess portion formed between adjacent turns of the first wire 43.

The common mode choke coil 41 further includes a top plate 54. The top plate 54 is composed of, for example, alumina as a non-magnetic body, a Ni—Zn based ferrite as a magnetic body, resin, or the like, similarly to the core 42. When the core 42 and the top plate 54 are made of a magnetic body and the top plate 54 is provided so as to connect the first flange portion 46 and the second flange portion 47, the core 42 cooperates with the top plate 54 to configure a closed magnetic loop.

SUMMARY

Technical Problem

In the above-described common mode choke coil 41, when a frequency of an input signal increases, a mode conversion characteristic may increase. The mode conversion characteristic represents a ratio of components, which are converted to common mode noise and outputted, to inputted differential signal components.

Occurrence of a similar problem is not limited to the common mode choke coil, for example, and such problem may arise in a wire-wound chip transformer similarly including a first wire and a second wire.

Accordingly, it is an object of this disclosure to provide a coil component capable of solving the above-described problem.

Solution to Problem

This disclosure is directed to a coil component including a core including a winding core portion which has a first end portion and a second end portion opposite to the first end portion, and a first wire and a second wire helically wound around the winding core portion with substantially the same number of turns as each other from the first end portion toward the second end portion. The first wire is wound in a state of constituting a first layer being in contact with the circumferential surface of the winding core portion, and the second wire is wound in a state of mostly constituting a second layer on the outside of the first layer and a part of the second wire in the second layer is fitted into a recess portion formed between adjacent turns of the first wire.

Note that, the second wire is wound in a state of "mostly" constituting the second layer on the outside of the first layer, because a small part of the second wire may need to be wound around the winding core portion so as to be in contact with the circumferential surface thereof due to the winding state in some situations.

In the coil component described above, when the number of turns of each of the first wire and the second wire counted from the first end portion side is expressed by n (n is a natural number), (1) a 0.5-displacement region in which the first wire and the second wire are displaced by 0.5 turns from each other, by an n-th turn or an (n+1)-th turn of the second wire being fitted into a recess portion between an n-th turn and an (n+1)-th turn of the first wire, and (2) a 1.5-displacement region in which the first wire and the second wire are displaced by 1.5 turns from each other, by an (n+2)-th turn of the second wire being fitted into the recess portion between the n-th turn and the (n+1)-th turn of the first wire, when the n-th turn of the second wire is fitted into the recess portion between the n-th turn and the (n+1)-th turn of the first wire in the 0.5-displacement region, or in which the first wire and the second wire are displaced by 1.5 turns from each other, by an (n−1)-th turn of the second wire being fitted into the recess portion between the n-th turn and the (n+1)-th turn of the first wire, when the (n+1)-th turn of the second wire is fitted into the recess portion between the n-th turn and the (n+1)-th turn of the first wire in the 0.5-displacement region, are distributed along an axis direction of the winding core portion.

The sum of the number of turns of the second wire located in the 0.5-displacement region is twice or more and five times or less of the sum of the number of turns of the second wire located in the 1.5-displacement region.

According to such a configuration, as being made clear through consideration described later, slant capacitances generated between the first and second wires can be balanced in the first and second wires as a whole.

Advantageous Effects of Disclosure

According to this disclosure, influence of a stray capacitance arises between the first and second wires can be reduced. Accordingly, for example, in a common mode choke coil, a mode conversion characteristic can be reduced.

DETAILED DESCRIPTION

First, matters found by the present inventors with respect to the problem in which the mode conversion characteristic (hereinafter, referred to as "Scd21") increases as described above will be described below.

A cause of the above-described problem is that a stray capacitance (distributed capacitance) which arises relating to a common mode choke coil 41 breaks a balance between signals passing through the common mode choke coil 41.

Figure 11:
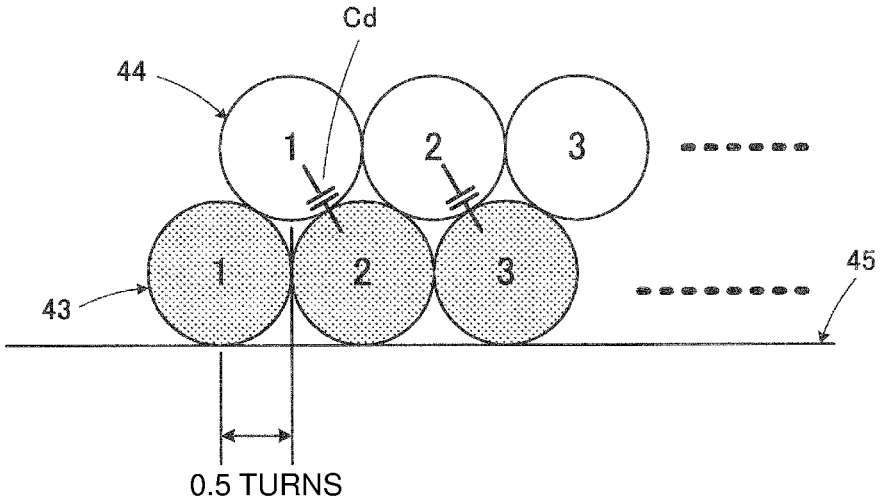
FIG. 11 is a sectional view for explaining slant capacitance generated between the first and second wires 43 and 44 illustrated in FIG. 9.

First, the stray capacitance generated in the common mode choke coil 41 will be described in more detail with reference to FIG. 11 and FIG. 12. In FIG. 11, a part of a state of winding first and second wires 43 and 44 around a winding core portion 45 is illustrated as a sectional view in an enlarged manner. In FIG. 11, a number illustrated in each of cross-sections of the first and second wires 43 and 44 represents the number of turns. In other words, in FIG. 11, a first turn to a third turn of each of the first and second wires and 44 are illustrated as a sectional view in an enlarged manner. Additionally, in FIG. 11, in order to clearly distinguish the first wire 43 and the second wire 44, cross-sections illustrating the first wire 43 are shaded.

As illustrated in FIG. 11, the first wire 43 constituting a first layer and the second wire 44 constituting a second layer are wound around the winding core portion 45 with a rule such that a first turn of the second wire 44 is fitted into a recess portion between a first turn and a second turn of the first wire 43, and a second turn of the second wire 44 is fitted into the recess portion between the second turn and a third turn of the first wire 43.

In general expression, an n-th turn of the second wire 44 is fitted into the recess portion between an n-th turn and an (n+1)-th turn of the first wire 43. As a result, locations of the first wire 43 and the second wire 44 do not match in an axis direction of the winding core portion 45, and displace by 0.5 turns from each other.

Figure 12:
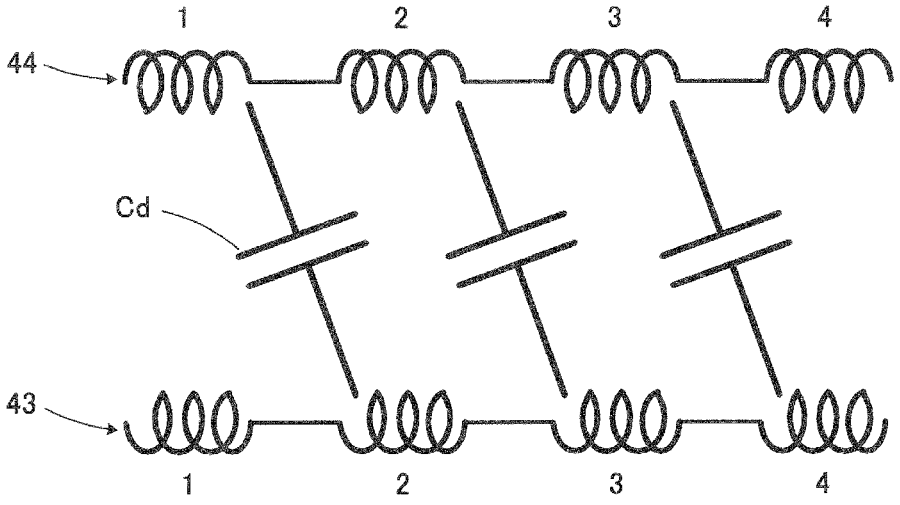
FIG. 12 is an equivalent circuit diagram for explaining the slant capacitance generated between the first and second wires 43 and 44 illustrated in FIG. 11 in more detail.

In FIG. 12, the first turn to a fourth turn of each of the wires 43 and 44 are illustrated. In FIG. 12, one turn of each of the wires 43 and 44 is illustrated using one inductor symbol, the same turns of the wires 43 and 44 are illustrated so as to be vertically aligned.

In such a winding state, stray capacitance (distributed capacitance) is generated between the first wire 43 and the second wire 44. Magnitude of the stray capacitance is proportional to a physical distance between the wires 43 and 44, and thus the stray capacitance generated between the adjacent wires 43 and 44 influences dominantly characteristics of the common mode choke coil 41. The stray capacitance generated between the adjacent wires 43 and 44 is, specifically, in FIG. 11 for example, the stray capacitance generated between the first turn of the first wire 43 and the first turn of the second wire 44, the stray capacitance generated between the second turn of the first wire 43 and the first turn of the second wire 44, or the like.

Here, the present inventors have found that, as a factor for increasing Scd21, a stray capacitance Cd between different turns of the first wire 43 and the second wire 44 (hereinafter, referred to as "slant capacitance Cd") among the stray capacitances generated between the adjacent wires 43 and 44 has greater influence. Accordingly, in FIG. 11 and FIG. 12, only the slant capacitances Cds are illustrated.

The slant capacitance Cd of the common mode choke coil is, for example, formed between the (n+1)-th turn of the first wire 43 and the n-th turn of the second wire, such as a portion between the second turn of the first wire 43 and the first turn of the second wire. Accordingly, in an equivalent circuit diagram in FIG. 12, in which the same turns of the first and second wires 43 and 44 are illustrated so as to be vertically aligned, the slant capacitance Cd has a connection attitude of so-called "rightward-descending". Note that, expression such as "rightward-descending" or "rightward-ascending" is also used in later descriptions.

Figure 10:
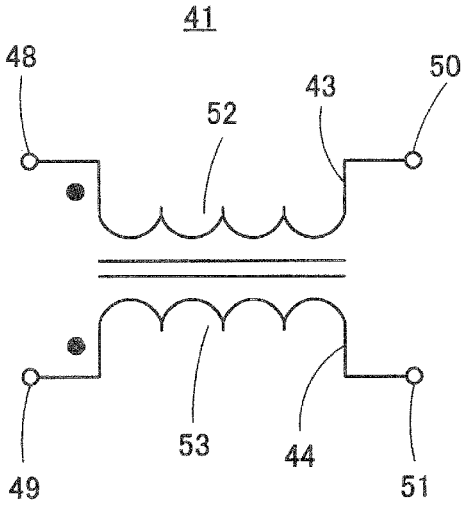
FIG. 10 is an equivalent circuit diagram of the common mode choke coil 41 illustrated in FIG. 9.

Next, influence of the connection attitude of "rightward-descending" on Scd21 will be described. First, in FIG. 10, it is assumed that a ratio of a signal outputted to a third terminal electrode 50 to a signal inputted from a first terminal electrode 48 is represented by S21, and a ratio of a signal outputted to a fourth terminal electrode 51 to a signal inputted from the first terminal electrode 48 is represented by S41. In addition, similarly, it is assumed that a ratio of a signal outputted to the third terminal electrode 50 to a signal inputted from a second terminal electrode 49 is represented by S23, and a ratio of a signal outputted to the fourth terminal electrode 51 to a signal inputted from the second terminal electrode 49 is represented by S43.

At this time, Scd21 is S21+S41−S23−S43, and by deforming the formula, Scd21=(S21−S43)+(S41−S23) is obtained. Here, S41 and S23 are characteristics for a signal propagating between the first wire 43 and the second wire 44, and are markedly influenced by a signal transmitted through the stray capacitance generated in particular between the first wire 43 and the second wire 44.

Here, in the common mode choke coil 41, by the presence of the above-described slant capacitance Cd, S41 and S23 have a partially different signal propagation path. For example, S41 is a value including the signal transmitted through a path by the slant capacitance Cd with an inclination of −1 (for example, a path from the second turn of the first wire 43 to the first turn of the second wire 44, or the like). The signal is transmitted as if the location thereof backs (reverses) by −1 turn, when propagating from the first wire 43 to the second wire 44. On the other hand, S23 is a value including a signal transmitted through a path by the slant capacitance Cd with the inclination of +1 (for example, a path from the second turn of the second wire 44 to the third turn of the first wire 43, or the like). The signal is transmitted as if the location thereof advances (short-cuts) by +1 turn, when propagating from the second wire to the first wire 43. Accordingly, the two signals as described above have different distances for passing through the inductors, attenuation characteristics of the signals are different from each other, asymmetry occurs between S41 and S23, and thus (S41−S23) does not become 0.

Note that, S41 and S23 also include a signal transmitted through a path by the stray capacitance generated between the same turns of the first wire 43 and the second wire (the inclination is 0). However, S41 and S23 of this path are symmetrical, and influence on a term of (S41−S23) can be substantially ignored.

As described above, the asymmetry of signal propagation characteristics caused by a difference between the inclinations of the slant capacitances Cds occurs between S41 and S23. Furthermore, the common mode choke coil 41 has a path of the slant capacitance Cd with the inclination of −1 on S41 side across substantially the entire turns, and has a path of the slant capacitance Cd with the inclination of +1 on S23 side across substantially the entire turns. In other words, due to the sum total of the signals transmitted through these paths, the asymmetry of the signal propagation characteristics between S41 and S23 increases further, and the term of (S41−S23) has a significant value, and thus Scd21 increases.

Note that, as the above-described stray capacitance, there may be a stray capacitance arising between the wires 43 and 44 and the terminal electrodes 48 to 51, a stray capacitance arising between wiring on a mounting substrate and a reference ground surface in a state where the common mode choke coil 41 is mounted on the substrate, or the like, in addition to the above-described stray capacitance arising between the wires 43 and 44. Normally, influence of the stray capacitances arising between the wires 43 and 44, particularly the influence by the sum total of the inclinations of the slant capacitances Cds is considered to be the largest.

The present inventors have focused on the sum total of the inclinations of the slant capacitances Cds by which the stated S41 and S23 are influenced, and have conceived embodiments described below.

Hereinafter, embodiments of this disclosure will be described regarding a common mode choke coil.

Figure 1:
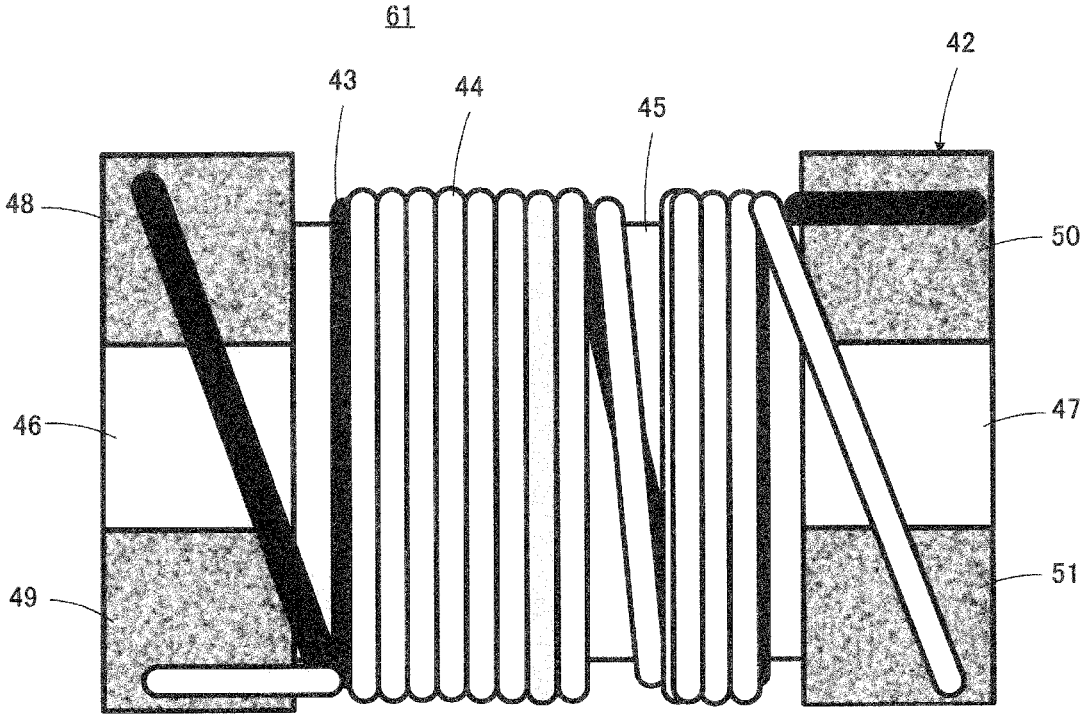
FIG. 1 is a bottom view of a common mode choke coil 61 as a coil component according to a first embodiment of this disclosure, and illustrates a surface facing toward a mounting substrate.
Figure 9:
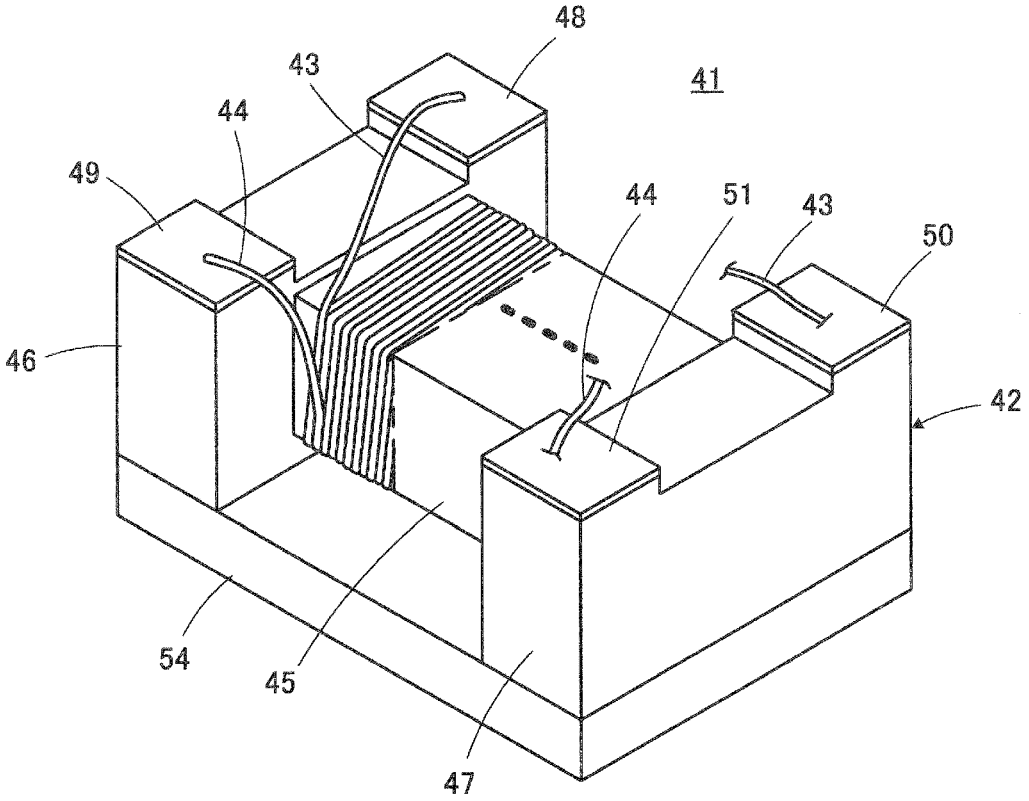
FIG. 9 is a perspective view illustrating an outer appearance of a common mode choke coil 41 having a configuration basically equivalent to that described in Japanese Patent No. 4789076.

FIG. 1 illustrates a common mode choke coil 61 according to a first embodiment of this disclosure. The common mode choke coil 61 illustrated in FIG. 1 is different from the above-described common mode choke coil 41 illustrated in FIG. 9 only in winding of the first and second wires 43 and 44, and the rest of the configuration is substantially the same. Accordingly, in FIG. 1, elements corresponding to the elements illustrated in FIG. 9 are given the same reference numerals, and redundant descriptions thereof will be omitted.

FIG. 1 illustrates a surface of the common mode choke coil 61 which faces toward a mounting substrate. Additionally, in FIG. 1, a top plate 54 illustrated in FIG. 9 is not illustrated. Furthermore, in FIG. 1, in order to clearly distinguish the first wire 43 and the second wire 44, the first wire 43 is illustrated by black, and the second wire 44 is illustrated by an outline.

Figure 2:
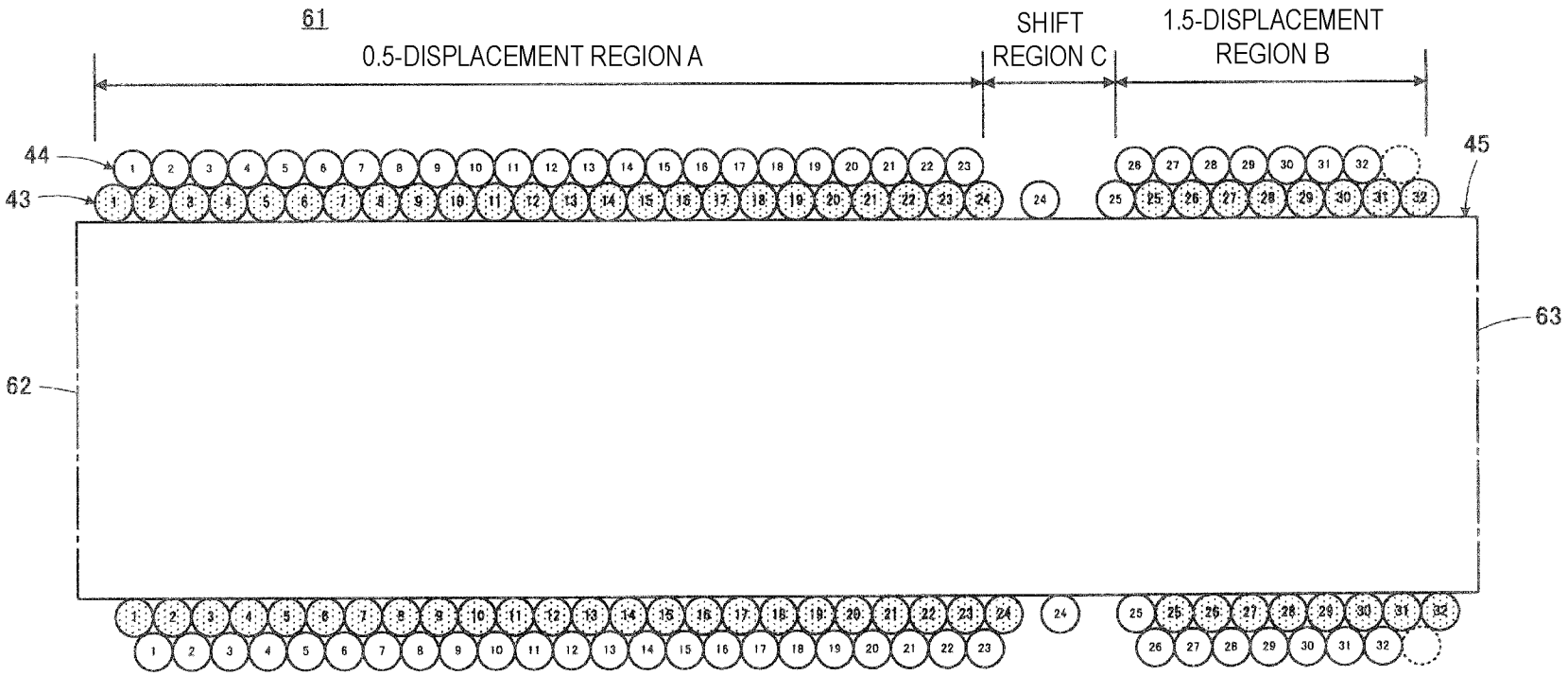
FIG. 2 is a sectional view schematically illustrating a state of winding first and second wires 43 and 44 of the common mode choke coil 61 illustrated in FIG. 1.

The state of winding the first and second wires 43 and of the common mode choke coil 61 illustrated in FIG. 1 is schematically illustrated as a sectional view in FIG. 2. Comparing FIG. 1 and FIG. 2, as is clear from the number of turns of the wires 43 and 44 illustrated in FIG. 1 being less than that illustrated in FIG. 2, the wires 43 and 44 are partially omitted and illustrated in FIG. 1. Additionally, in FIG. 2 and subsequent drawings, a cross-section illustrating the first wire 43 is shaded in order to be clearly distinguished from the second wire 44.

The first and second wires 43 and 44 are helically wound around a winding core portion 45 with substantially the same number of turns as each other from a first end portion 62 side to which a first flange portion 46 is provided toward a second end portion 63 to which a second flange portion 47 is provided (opposite to the first end portion 62). In cross-sections of the first and second wires 43 and 44 illustrated in FIG. 2, the numbers of turns "1" to "32" counted from the first end portion 62 side of the winding core portion 45 are respectively illustrated. Illustration of the number of turns is adopted in each of the cross-sections of the first and second wires 43 and 44 in FIG. 3 and FIG. 4, and FIG. 7 and FIG. 8 described later as well.

The first wire 43 is wound in a state of constituting a first layer being in contact with the circumferential surface of the winding core portion 45, and the second wire 44 is wound in a state of mostly constituting a second layer on the outside of the first layer and a part of the second wire in the second layer is fitted into a recess portion formed between adjacent turns of the first wire.

Figure 3:
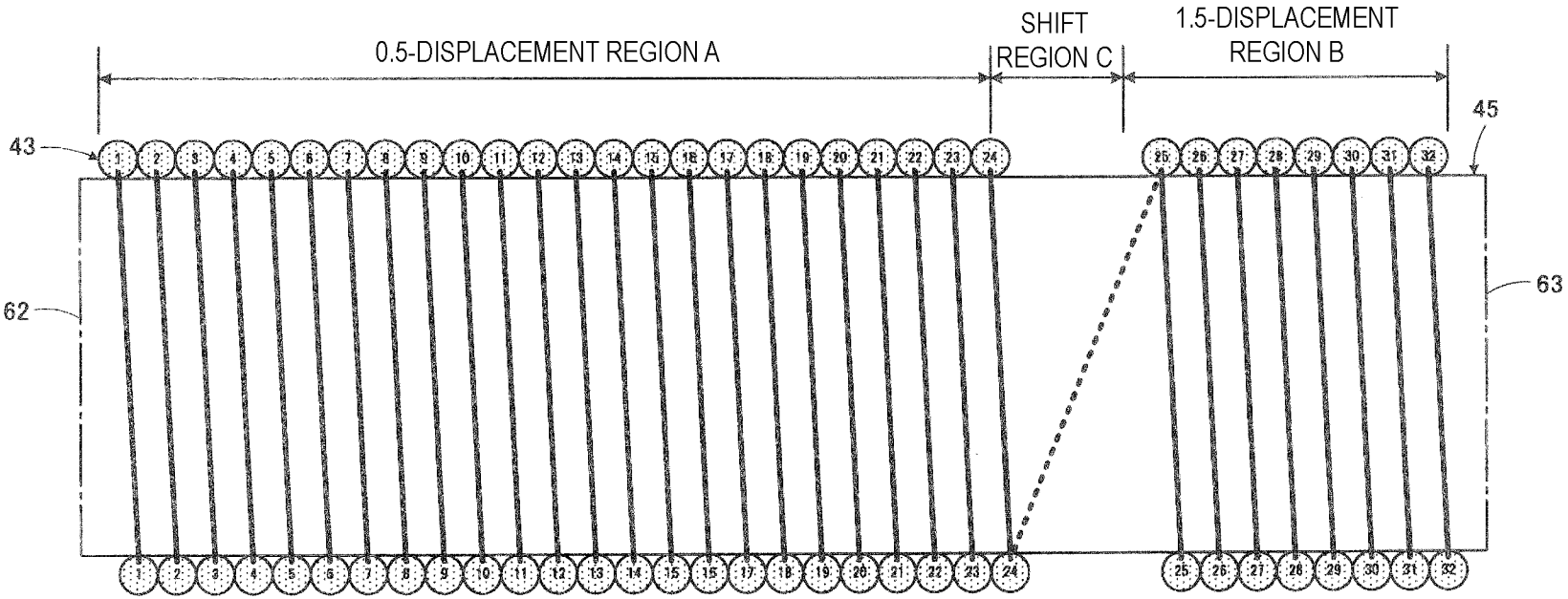
FIG. 3 is a sectional view for explaining a winding procedure of the first wire 43 illustrated in FIG. 2.
Figure 4:
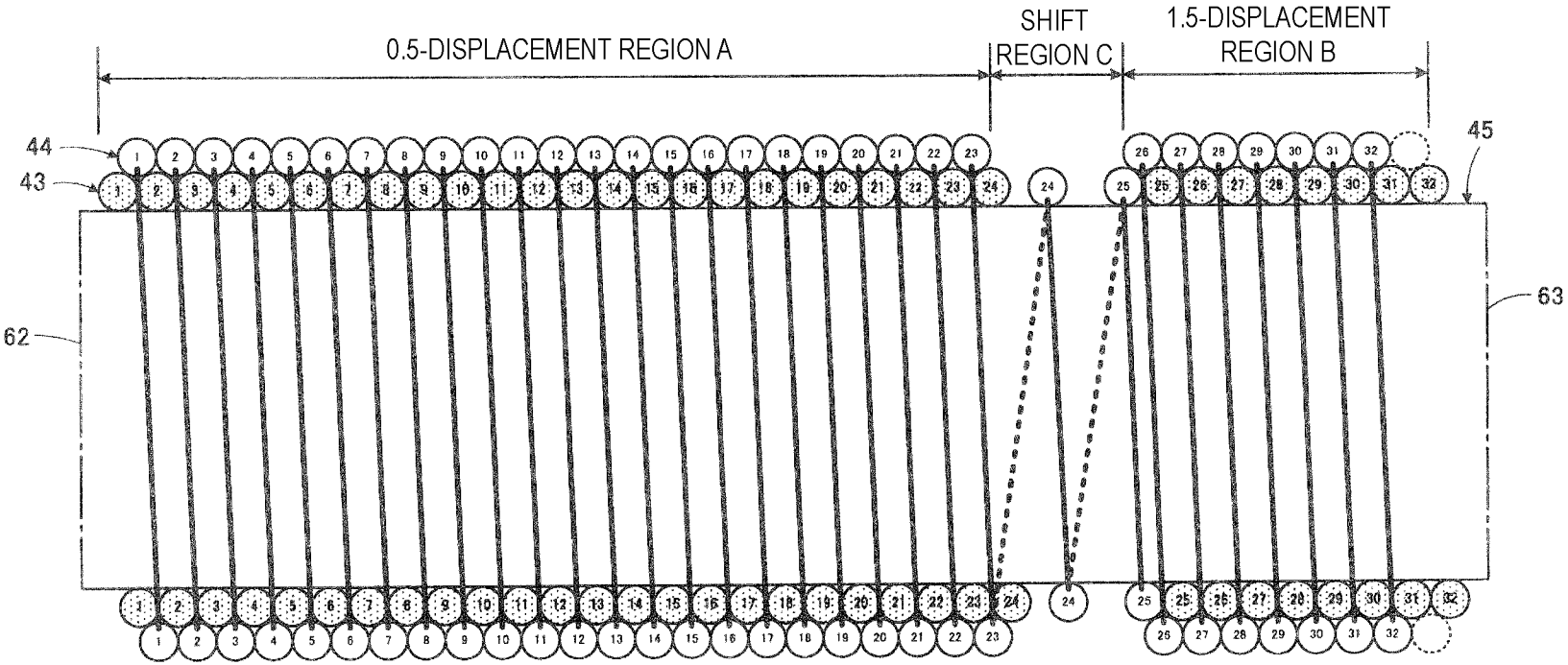
FIG. 4 is a sectional view for explaining a winding procedure of the second wire 44 illustrated in FIG. 2.

The states of winding the first and second wires 43 and 44 will be described in detail with reference to FIG. 3 and FIG. 4 along with FIG. 2. FIG. 3 and FIG. 4 schematically illustrate, each of parts of the first and second wires 43 and 44 wound around the winding core portion 45, a part located on the front side of the winding core portion 45 by a solid line, and a part hidden by the winding core portion 45 by a broken line. Note that, the parts of the wires 43 and 44 hidden by the winding core portion 45 are not entirely illustrated, only characteristic parts are illustrated by a broken line.

Furthermore, in FIG. 2 to FIG. 4, a "0.5-displacement region A", a "shift region C" and a "1.5-displacement region B" are illustrated in this order from the first end portion 62 toward the second end portion 63 of the winding core portion 45. In other words, along an axis direction of the winding core portion 45, the 0.5-displacement region A, the shift region C, and the 1.5-displacement region B are distributed. The source of names of these regions A to C will be made clear through descriptions described later. The states of winding the first and second wires 43 and 44 are described individually for the regions A to C.

First, a starting end of the first wire 43 is connected to a first terminal electrode 48 (see FIG. 1).

Next, mainly referring to FIG. 3, in the 0.5-displacement region A, the first wire 43 is wound from a first turn to a 24th turn in a state where a gap is not formed between adjacent turns.

Next, in the shift region C, a portion in which the first wire 43 shifts from the 24th turn to a 25th turn is located, and the gap is formed between the 24th turn and the 25th turn.

Next, in the 1.5-displacement region B, the first wire 43 is wound again from the 25th turn to a 32nd turn in a state where the gap is not formed between adjacent turns.

Then, a terminating end of the first wire 43 is connected to a third terminal electrode 50 (see FIG. 1). Thereafter, the second wire 44 is wound.

First, a starting end of the second wire 44 is connected to a second terminal electrode 49 (see FIG. 1).

Next, mainly referring to FIG. 4, in the 0.5-displacement region A, the second wire 44 is wound from a first turn to a 23rd turn, such that the first turn of the second wire 44 is fitted into the recess portion between, for example, the first turn and a second turn of the first wire 43, in other words, generally expressing, in a state where an n-th turn of the second wire 44 is fitted into the recess portion between an n-th turn and an (n+1)-th turn of the first wire 43.

Next, in the shift region C, a 24th turn of the second wire 44 is wound in a state where the gap is formed with respect to the 23rd turn. Furthermore, a 25th turn is wound in a state where the gap is formed with respect to the 24th turn. The 24th turn and the 25th turn are wound in a state of being in contact with the circumferential surface of the winding core portion 45. At this time, as is clear from comparison between FIG. 3 and FIG. 4, the second wire 44 intersects with the first wire 43 at three points.

Next, in the 1.5-displacement region B, a 26th turn of the second wire 44 is first fitted into the recess portion between the 25th turn of the second wire 44 and the 25th turn of the first wire 43. Subsequently, the second wire 44 is wound from the 26th turn to a 32nd turn, such that a 27th turn of the second wire 44 is fitted into the recess portion between, for example, the 25th turn and a 26th turn of the first wire 43, in other words, generally expressing, in a state where an (n+2)-th turn of the second wire 44 is fitted into the recess portion between the n-th turn and the (n+1)-th turn of the first wire 43.

Then, a terminating end of the second wire 44 is connected to a fourth terminal electrode 51 (see FIG. 1).

Note that, in FIG. 2 and FIG. 4, a circle illustrated by a dotted line and adjacent to the second wire 44 clearly indicates that a part which is not wound, in other words, a "void" is formed therein.

Figure 5:
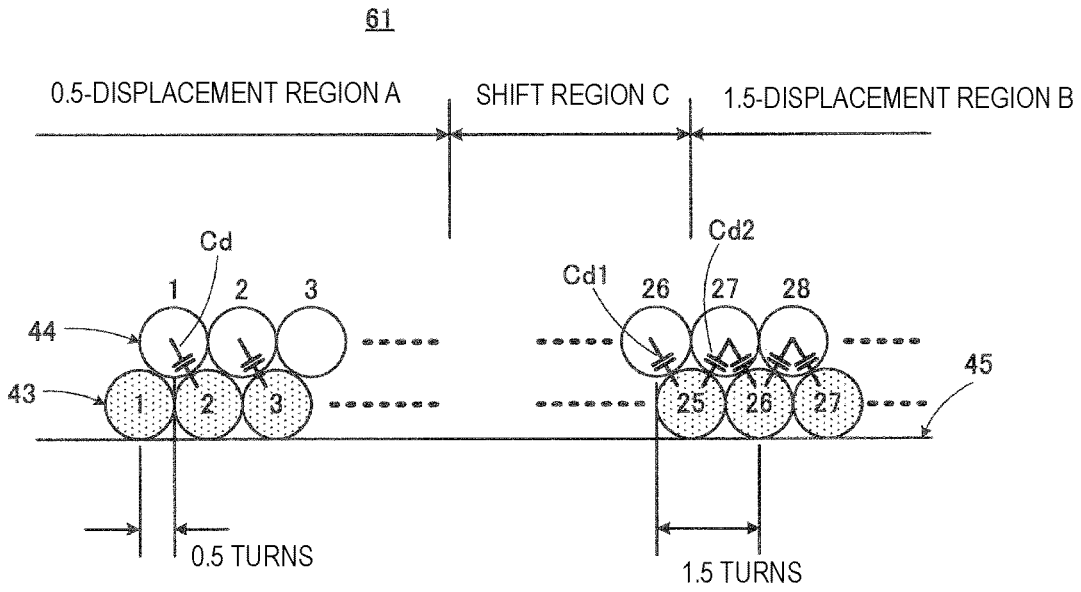
FIG. 5 is a sectional view for explaining slant capacitance generated between the first and second wires 43 and 44 illustrated in FIG. 2.

A slant capacitance generated in the common mode choke coil 61 configured as described above will be described with reference to FIG. 5 and FIG. 6. In FIG. 5, a part of the state of winding the first and second wires 43 and 44 around the winding core portion 45 is illustrated as a sectional view in an enlarged manner. In FIG. 5, a number illustrated in each cross-section or in the vicinity of each cross-section of the first and second wires 43 and 44 denotes the number of turns. In other words, in FIG. 5, the first turn to a third turn of each of the first and second wires 43 and 44, the 25th turn to a 27th turn of the first wire 43, and the 26th turn to a 28th turn of the second wire 44 are illustrated.

As illustrated in FIG. 5, the first wire 43 and the second wire 44 are displaced by 0.5 turns from each other in the 0.5-displacement region A. Therefore, the name of "0.5-displacement region" is given. On the other hand, the first wire 43 and the second wire 44 are displaced by 1.5 turns from each other in the 1.5-displacement region B. Therefore, the name of "1.5-displacement region" is given. The "shift region" refers to a region for shifting from the 0.5-displacement region A to the 1.5-displacement region B.

Figure 6:
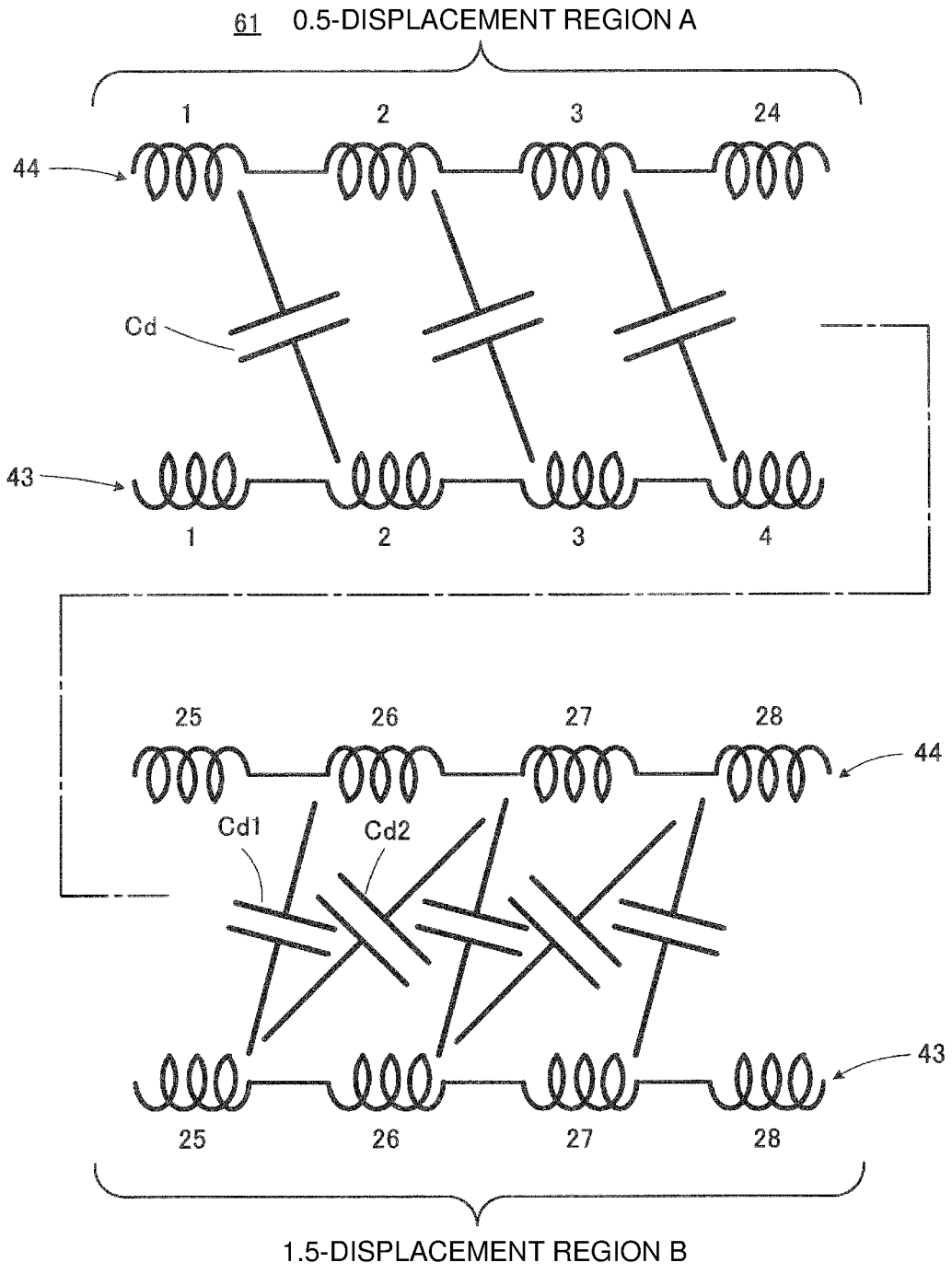
FIG. 6 is an equivalent circuit diagram for explaining the slant capacitance generated between the first and second wires 43 and 44 illustrated in FIG. 5 in more detail.

In FIG. 6, using the same method as in FIG. 12, while the same turns of each of the first and second wires 43 and 44 being illustrated so as to be vertically aligned, the stray capacitance (slant capacitance) generated between different turns of the first and second wires 43 and 44 illustrated in FIG. 5 is illustrated as an equivalent circuit diagram.

In the 0.5-displacement region A, arrangement of the first wire 43 and the second wire 44 is the same as the arrangement illustrated in the above-described FIG. 11, and the same equivalent circuit as the equivalent circuit illustrated in FIG. 12 is formed. Accordingly, in the 0.5-displacement region A illustrated in FIG. 5, a slant capacitance Cd of so-called "rightward-descending" is formed between the first wire 43 and the second wire 44 as indicated in the 0.5-displacement region A in FIG. 6. In particular, when seen from the second wire 44 side, an inclination of the slant capacitance Cd in the 0.5-displacement region A is "+1".

On the other hand, in the 1.5-displacement region B, as illustrated in FIG. 5, slant capacitances Cd1 and Cd2 are formed between the first wire 43 and the second wire 44. As indicated in the 1.5-displacement region in FIG. 6, in the equivalent circuit diagram, the slant capacitances Cd1 and Cd2 both have a connection attitude of so-called "rightward-ascending". In particular, when seen from the second wire 44 side, the inclination of the slant capacitance Cd1 is "−1" and the inclination of the slant capacitance Cd2 is "−2" in the 1.5-displacement region B.

Here, the slant capacitance Cd and the slant capacitances Cd1 and Cd2 are expressed in numerals, and magnitude and an effect thereof will be considered.

For example, like the slant capacitance Cd in 0.5-displacement region A illustrated in FIG. 6, when the connection attitude is "rightward-descending", a sign "+" is appended in numerically expressing the slant capacitance. Conversely, for example, like the slant capacitance Cd1 or Cd2 in the 1.5-displacement region B illustrated in FIG. 6, when the connection attitude is "rightward-ascending", a sign "−" is appended in numerically expressing the slant capacitance.

Additionally, like the slant capacitance Cd in the 0.5-displacement region A illustrated in FIG. 6 or the slant capacitance Cd1 in the 1.5-displacement region B illustrated in FIG. 6, when a difference, which generates the slant capacitance, between the number of turns on the first wire 43 side and the number of turns on the second wire 44 side is "1", an absolute value of the slant capacitance is expressed in a numeral of "1". Additionally, like the slant capacitance Cd2 in the 1.5-displacement region B illustrated in FIG. 6, when a difference, which generates the slant capacitance, between the number of turns on the first wire 43 side and the number of turns on the second wire 44 side is an absolute value of the slant capacitance is expressed in a numeral of "2".

In accordance with the above-described rule, the slant capacitance Cd arising in the 0.5-displacement region A in FIG. 5 can be expressed in a numeral of "+1". In other words, in the 0.5-displacement region A, the slant capacitance of "+1" arises for one turn of the second wire 44. Additionally, the slant capacitance Cd1 arising in the 1.5-displacement region B in FIG. 5 can be expressed in a numeral of "−1", and similarly the slant capacitance Cd2 arising in the 1.5-displacement region B in FIG. 5 can be expressed in a numeral of "−2". Accordingly, in the 1.5-displacement region B, the slant capacitance of (−1)+(−2) =−3 arises for one turn of the second wire 44.

Here, assuming that the sum of the number of turns of the second wire 44 located in the 0.5-displacement region A is represented by $N_{0.5}$, the sum of the number of turns of the second wire 44 located in the 1.5-displacement region B is represented by $N_{1.5}$, the slant capacitance of $+1\times N_{0.5}$ is generated in the 0.5-displacement region A as a whole, and the slant capacitance of $-3\times N_{1.5}$ is generated in the 1.5-displacement region B as a whole.

Accordingly, when the sum $N_{0.5}$ of the number of turns of the second wire 44 located in the 0.5-displacement region A is three times the sum $N_{1.5}$ of the number of turns of the second wire 44 located in the 1.5-displacement region B, in other words, when $N_{0.5}=N_{1.5}\times 3$ is established, the slant capacitance of $+1\times N_{0.5}=+1\times N_{1.5}\times 3=+3\times N_{1.5}$ is generated in the 0.5-displacement region A as a whole, and is canceled out by the slant capacitance of $-3\times N_{1.5}$ in the 1.5-displacement region B as a whole, and thus the slant capacitance generated between the first and second wires 43 and 44 can be balanced in the first and second wires 43 and 44 as a whole. Accordingly, influence of the slant capacitance arising between the first and second wires 43 and 44 can be reduced, and a mode conversion characteristic of the common mode choke coil 61 can be reduced.

Note that, actually, as the stray capacitance which influences the mode conversion characteristic, there may be the stray capacitance arising between the wires 43 and 44 and the terminal electrodes 48 to 51, the stray capacitance arising between wiring on a mounting substrate and a reference ground surface in a state where the common mode choke coil 41 is mounted on the substrate, or the like, in addition to the above-described stray capacitance arising between the wires 43 and 44. Accordingly, in consideration of these stray capacitances or the like, furthermore, in consideration of a case where the number of turns of the second wire 44 may not be divisible at 1:3, the above-described sum $N_{0.5}$ of the number of turns of the second wire 44 located in the 0.5-displacement region A is not limited to exactly three times the sum $N_{1.5}$ of the number of turns of the second wire 44 located in the 1.5-displacement region B, and may be twice or more and five times or less of the sum $N_{1.5}$ according to the range of this disclosure.

Regarding the specific winding state illustrated in FIG. 2, the sum $N_{0.5}$ of the number of turns of the second wire 44 in the 0.5-displacement region A is "23", and the sum $N_{1.5}$ of the number of turns of the second wire 44 in the 1.5-displacement region B is "6". Accordingly, the sum $N_{0.5}$ of the number of turns of the second wire 44 is $23/6\approx 3.8$ times the sum $N_{1.5}$ of the number of turns of the second wire 44.

As described above, for the value of $N_{0.5}/N_{1.5}$, a range of twice or more and five times or less is provided in this disclosure. In the case of the winding illustrated in FIG. 2, the total number of turns, which belong to the 0.5-displacement region A and the 1.5-displacement region B, of the second wire 44, which serves as the second layer, in a state of being located over the first wire 43 constituting the first layer, in other words, $N_{0.5}+N_{1.5}$ is 29.The number $N_{0.5}+N_{1.5}=29$ is divided into two, when $N_{0.5}$ is 20 and $N_{1.5}$ is 9, $N_{0.5}/N_{1.5}$ is approximately 2.2,
when $N_{0.5}$ is 21 and $N_{1.5}$ is 8,$N_{0.5}/N_{1.5}$ is approximately 2.6,
when $N_{0.5}$ is 22 and $N_{1.5}$ is 7, $N_{0.5}/N_{1.5}$ is approximately 3.1,
when $N_{0.5}$ is 23 and $N_{1.5}$ is 6,$N_{0.5}/N_{1.5}$ is approximately 3.8, and
when $N_{0.5}$ is 24 and $N_{1.5}$ is 5, $N_{0.5}/N_{1.5}$ is 4.8.

Accordingly, in any of the stated cases, the value of $N_{0.5}/N_{1.5}$ is in the range of twice or more and five times or less, and it can be said that the value is in the range of this disclosure.

Figure 7:
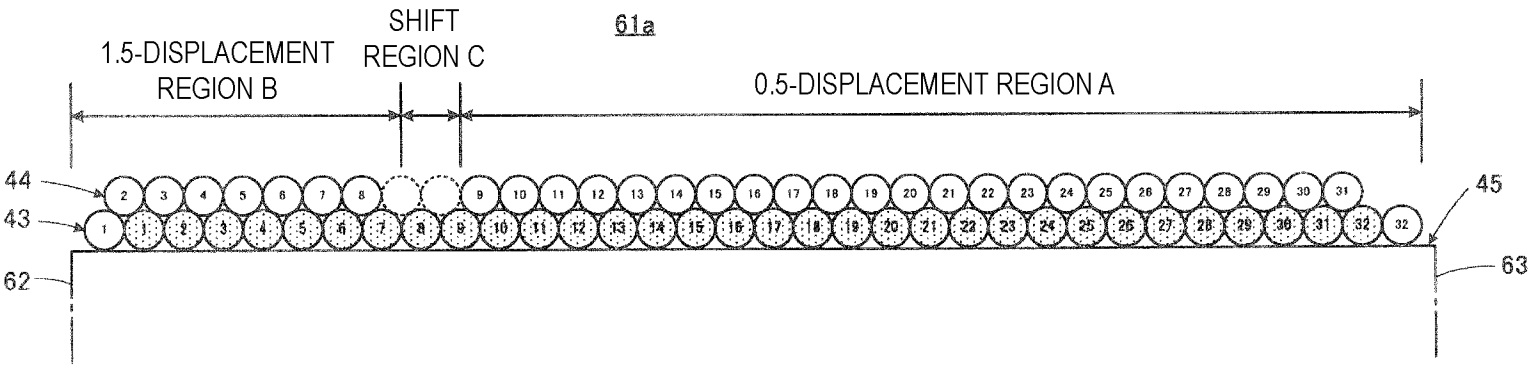
FIG. 7 is a diagram corresponding to an upper half of FIG. 2, and is a sectional view schematically illustrating a state of winding the first and second wires 43 and 44 of a common mode choke coil 61*a* according to a second embodiment of this disclosure.

Next, a common mode choke coil 61*a* according to a second embodiment of this disclosure will be described with reference to FIG. 7. FIG. 7 illustrates a state of winding the first and second wires 43 and 44 in the common mode choke coil 61*a*. FIG. 7 is a diagram corresponding to the upper half of FIG. 2. Accordingly, in FIG. 7, elements corresponding to the elements illustrated in FIG. 2 are given the same reference numerals, and redundant descriptions thereof will be omitted.

In the common mode choke coil 61*a* illustrated in FIG. 7, along the axis direction of the winding core portion 45, reversely to the case of the common mode choke coil 61 illustrated in FIG. 2, the 1.5-displacement region B, the shift region C, and the 0.5-displacement region A are distributed in this order from the first end portion 62 toward the second end portion 63.

The first wire 43 is wound from the first turn to the 32nd turn, across the 1.5-displacement region B, the shift region C, and the 0.5-displacement region A, in a state where the gap is not formed between adjacent turns.

The second wire 44 is wound from the first turn to an eighth turn in the 1.5-displacement region B. First, the first turn of the second wire 44 is wound in a state of being in contact with the circumferential surface of the winding core portion 45 and in contact with the first turn of the first wire, and a second turn is wound so as to be fitted into the recess portion between the first turn of the second wire 44 and the first turn of the first wire 43. Hereinafter, the second wire 44 is wound such that the third turn is fitted into the recess portion between the first turn and the second turn of the first wire 43, in other words, generally expressing, such that the (n+2)-th turn of the second wire 44 is fitted into the recess portion between the n-th turn and the (n+1)-th turn of the first wire 43.

Next, in the shift region C, a portion in which the second wire 44 shifts from the eighth turn to a ninth turn is located. As a "void" part being formed in which the wire is not wound is indicated by a dotted line circle, the gap is formed between the eighth turn and the ninth turn of the second wire 44. At this time, although not illustrated in the drawings, the second wire 44 intersects with the first wire 43 at three points.

Next, in the 0.5-displacement region A, the second wire 44 is wound from the ninth turn to a 31st turn, such that the ninth turn of the second wire 44 is fitted into the recess portion between a ninth turn and a tenth turn of the first wire 43, for example, in other words, generally expressing, in a state where the n-th turn of the second wire 44 is fitted into the recess portion between the n-th turn and the (n+1)-th turn of the first wire 43. Finally, the 32nd turn of the second wire is wound in a state of being in contact with the circumferential surface of the winding core portion 45 and in contact with the 32nd turn of the first wire.

In the specific winding state illustrated in FIG. 7 as described above, the sum $N_{1.5}$ of the number of turns of the second wire 44 is "6" in the 1.5-displacement region B, the sum $N_{0.5}$ of the number of turns of the second wire 44 is "23" in the 0.5-displacement region A. Accordingly, the sum $N_{0.5}$ of the number of turns of the second wire 44 is 23/6≈3.8 times the sum $N_{1.5}$ of the number of turns of the second wire 44.

Figure 8:
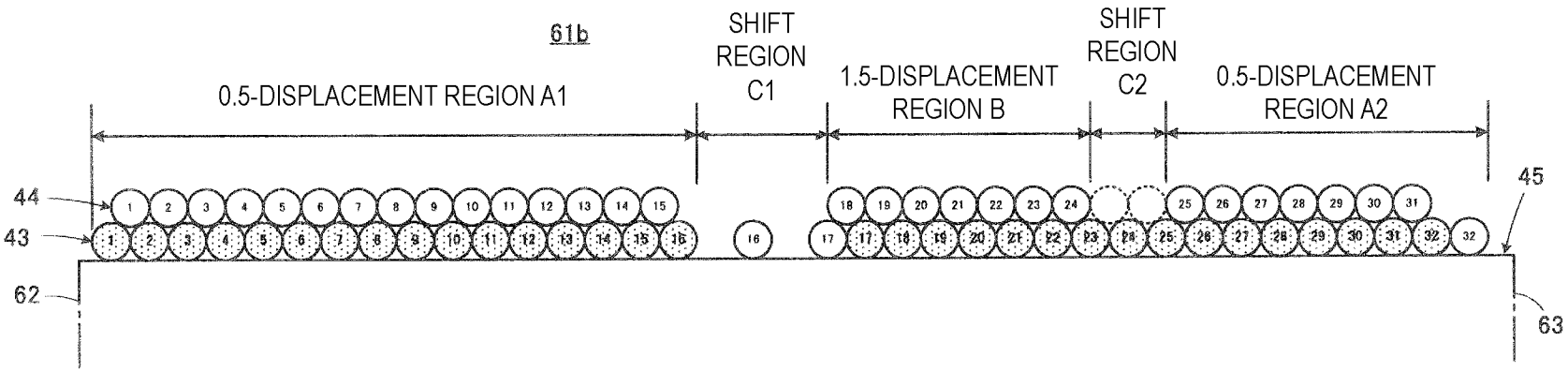
FIG. 8 is a diagram corresponding to an upper half of FIG. 2, and is a sectional view schematically illustrating a state of winding the first and second wires 43 and 44 of a common mode choke coil 61*b* according to a third embodiment of this disclosure.

Next, a common mode choke coil 61*b* according to a third embodiment of this disclosure will be described with reference to FIG. 8. FIG. 8 illustrates, similarly to FIG. 7, a state of winding the first and second wires 43 and 44 in the common mode choke coil 61*b*. FIG. 8 is a diagram corresponding to the upper half of FIG. 2. Accordingly, in FIG. 8, elements corresponding to the elements illustrated in FIG. 2 are given the same reference numerals, and redundant descriptions thereof will be omitted.

In the common mode choke coil 61*b* illustrated in FIG. 8, along the axis direction of the winding core portion 45, a first 0.5-displacement region A1, a first shift region C1, the 1.5-displacement region B, a second shift region C2, and a second 0.5-displacement region A2 are distributed in this order from the first end portion 62 toward the second end portion 63.

The first wire 43 is wound from the first turn to a 16th turn, in the first 0.5-displacement region A1, in a state where the gap is not formed between adjacent turns.

Next, in the first shift region C1, a portion in which the first wire 43 shifts from the 16th turn to a 17th turn is located, and the gap is formed between the 16th turn and the 17th turn.

Next, across the 1.5-displacement region B, the second shift region C2, and the second 0.5-displacement region A2, the first wire 43 is wound again from the 17th turn to the 32nd turn in a state where the gap is not formed between adjacent turns.

On the other hand, in the first 0.5-displacement region A1, the second wire 44 is wound from the first turn to a 15th turn, such that the first turn of the second wire 44 is fitted into the recess portion between, for example, the first turn and the second turn of the first wire 43, in other words, generally expressing, in a state where the n-th turn of the second wire 44 is fitted into the recess portion between the n-th turn and the (n+1)-th turn of the first wire 43.

Next, in the first shift region C1, a 16th turn of the second wire 44 is wound in a state where the gap is formed with respect to the 15th turn, furthermore, a 17th turn is wound in a state where the gap is formed with respect to the 16th turn. These 16th turn and 17th turn are wound in a state of being in contact with the circumferential surface of the winding core portion 45. At this time, although not illustrated in the drawings, the second wire 44 intersects with the first wire 43 at three points.

Next, in the 1.5-displacement region B, the second wire 44 is first wound in a state where an 18th turn is fitted into the recess portion between the 17th turn of the second wire 44 and the 17th turn of the first wire 43. Subsequently, the second wire 44 is wound from the 18th turn to the 24th turn such that a 19th turn of the second wire 44 is fitted into the recess portion between, for example, the 17th turn and an 18th turn of the first wire 43, in other words, generally expressing, in a state where the (n+2)-th turn of the second wire 44 is fitted into the recess portion between the n-th turn and the (n+1)-th turn of the first wire 43.

Next, in the second shift region C2, a portion in which the second wire 44 shifts from the 24th turn to the 25th turn is located. As a "void" part being formed in which the wire is not wound is indicated by a dotted line circle, the gap is formed between the 24th turn and the 25th turn. At this time, although not illustrated in the drawings, the second wire 44 intersects with the first wire 43 at three points.

Next, in the second 0.5-displacement region A2, the second wire 44 is wound from the 25th turn to the 31st turn such that the 25th turn of the second wire 44 is fitted into the recess portion between, for example, the 25th turn and the 26th turn of the first wire 43, in other words, generally expressing, in a state where the n-th turn of the second wire 44 is fitted into the recess portion between the n-th turn and the (n+1)-th turn of the first wire 43. Finally, the 32nd turn of the second wire 44 is wound in a state of being in contact with the circumferential surface of the winding core portion 45 and in contact with the 32nd turn of the first wire.

In the specific winding state illustrated in FIG. 8 as described above, the sum $N_{0.5}$ of the total number of turns of the second wire 44 is "22" in the two 0.5-displacement regions A1 and A2, and the sum $N_{1.5}$ of the number of turns of the second wire 44 is "6" in the 1.5-displacement region B. Accordingly, the sum $N_{0.5}$ of the number of turns of the second wire 44 is 22/6≈3.7 times the sum $N_{1.5}$ of the number of turns of the second wire 44.

As a variation on the embodiment illustrated in FIG. 8, the region divided into the two 0.5-displacement regions A1 and A2 may be further divided into three regions or more, or, the 1.5-displacement region B may be divided so as to be distributed to a plurality of regions. In other words, in the embodiment illustrated in FIG. 8, it is significant to clearly indicate that at least one of the 0.5-displacement region and the 1.5-displacement region may be distributed to the plurality of regions.

As described above, the common mode choke coil 61, 61*a*, and 61*b* described with reference to the drawings all include the displacements by 0.5 turns generated between the first wire 43 and the second wire 44, by the n-th turn of the second wire 44 being fitted into the recess portion between the n-th turn and the (n+1)-th turn of the first wire 43 in the 0.5-displacement region A, A1, and A2. In this case, as seen in the common mode choke coil 61, 61*a*, and 61*b*, by the (n+2)-th turn of the second wire 44 being fitted into the recess portion between the n-th turn and the (n+1)-th turn of the first wire 43 in the 1.5-displacement region B, the configuration for generating displacement by 1.5 turns between the first wire 43 and the second wire 44 is employed.

However, embodiments of this disclosure are not limited to the stated case, by an (n+1)-th turn of the second wire being fitted into the recess portion between the n-th turn and the (n+1)-th turn of the first wire in the 0.5-displacement region, a displacement by 0.5 turns may be generated between the first wire 43 and the second wire 44. In this case, by an (n−1)-th turn of the second wire being fitted into the recess portion between the n-th turn and the (n+1)-th turn of the first wire 43 in the 1.5-displacement region, the configuration for generating a displacement by 1.5 turns between the first wire and the second wire is employed.

Note that, the above-described configuration is merely a configuration in which a direction for counting the number of turns is reversed (for example, counted from the second end portion 63 side) in the configurations included in the embodiments illustrated in the drawings, and can be understood as substantially the same configuration. Accordingly, illustration thereof is omitted.

As described above, although this disclosure has been described using embodiments according to the common mode choke coil illustrated in the drawings, this disclosure can be applied to a wire-wound chip transformer. Additionally, embodiments illustrated in the drawings are merely examples, and it should be noted that partial replacements or combinations of configurations among different embodiments are also possible.

The invention claimed is:

1. A coil component comprising:

a core including a winding core portion which has a first end portion and a second end portion opposite to the first end portion; and a first wire and a second wire helically wound around the winding core portion with substantially a same number of turns as each other from the first end portion toward the second end portion, wherein the first wire is wound in a state of constituting a first layer being in contact with a circumferential surface of the winding core portion;

the second wire is wound in a state of mostly constituting a second layer on an outside of the first layer and a part of the second wire in the second layer is fitted into a recess portion formed between adjacent turns of the first wire;

when the number of turns of each of the first wire and the second wire counted from the first end portion side is expressed by n, and n being a natural number:

(1) a 0.5-displacement region is distributed along an axis direction of the winding core portion in which the first wire and the second wire are displaced by 0.5 turns from each other by an n-th turn or an (n+1)-th turn of the second wire being fitted into a recess portion between an n-th turn and an (n+1)-th turn of the first wire, and either (2)

(a) a 1.5-displacement region is distributed along the axis direction of the winding core portion in which the first wire and the second wire are displaced by 1.5 turns from each other, by an (n+2)-th turn of the second wire being fitted into the recess portion between the n-th turn and the (n+1)-th turn of the first wire, when the n-th turn of the second wire is fitted into the recess portion between the n-th turn and the (n+1)-th turn of the first wire in the 0.5-displacement region, or, (b) a 1.5-displacement region is distributed along the axis direction of the winding core portion in which the first wire and the second wire are displaced by 1.5 turns from each other, by an (n−1)-th turn of the second wire being fitted into the recess portion between the n-th turn and the (n+1)-th turn of the first wire, when the (n+1)-th turn of the second wire is fitted into the recess portion between the n-th turn and the (n+1)-th turn of the first wire in the 0.5-displacement region; and the sum of the number of turns of the second wire located in the 0.5-displacement region is twice or more and five times or less than the sum of the number of turns of the second wire located in the 1.5-displacement region.

* * * * *